US012790674B2

(12) United States Patent
Yang et al.

(10) Patent No.: US 12,790,674 B2
(45) Date of Patent: Nov. 10, 2026

(54) HIGH-STRENGTH COLD-ROLLED STEEL SHEET AND METHOD FOR MANUFACTURING SAME

(71) Applicant: JFE Steel Corporation, Tokyo (JP)

(72) Inventors: Lingling Yang, Tokyo (JP); Yuki Toji, Tokyo (JP); Ryohei Morimoto, Tokyo (JP); Katsutoshi Takashima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 445 days.

(21) Appl. No.: 18/285,524

(22) PCT Filed: Mar. 2, 2022

(86) PCT No.: PCT/JP2022/008708
§ 371 (c)(1),
(2) Date: Oct. 4, 2023

(87) PCT Pub. No.: WO2022/215389
PCT Pub. Date: Oct. 13, 2022

(65) Prior Publication Data

US 2024/0110264 A1 Apr. 4, 2024

(30) Foreign Application Priority Data

Apr. 9, 2021 (JP) ..... 2021-066342

(51) Int. Cl.

| | |
|---|---|
| ***C22C 38/04*** | (2006.01) |
| ***C21D 8/02*** | (2026.01) |
| ***C21D 8/0221*** | (2026.01) |
| ***C21D 8/0247*** | (2026.01) |
| ***C22C 38/02*** | (2006.01) |
| ***C22C 38/06*** | (2006.01) |
| ***C23C 2/02*** | (2006.01) |
| ***C23C 2/06*** | (2006.01) |

(52) U.S. Cl.
CPC ..... *C22C 38/04* (2013.01); *C21D 8/02* (2013.01); *C21D 8/0226* (2013.01); *C21D 8/0236* (2013.01); *C21D 8/0273* (2013.01); *C22C 38/02* (2013.01); *C22C 38/06* (2013.01); *C23C 2/0224* (2022.08); *C23C 2/06* (2013.01); *C21D 2211/001* (2013.01); *C21D 2211/002* (2013.01); *C21D 2211/008* (2013.01)

(58) Field of Classification Search
CPC ..... C22C 38/02; C22C 38/04
See application file for complete search history.

(56) References Cited

U.S. PATENT DOCUMENTS

| | | | |
|---|---|---|---|
| 2014/0322559 | A1 | 10/2014 | Becker et al. |
| 2017/0145535 | A1 | 5/2017 | Fjer et al. |
| 2019/0071757 | A1 | 3/2019 | Murata et al. |
| 2019/0085426 | A1 | 3/2019 | Ikeda et al. |
| 2019/0203315 | A1 | 7/2019 | Obata et al. |
| 2022/0081734 | A1 | 3/2022 | Yang et al. |

FOREIGN PATENT DOCUMENTS

| | | | | |
|---|---|---|---|---|
| CN | 109642281 | A | | 4/2019 |
| JP | 2006070346 | A | | 3/2006 |
| JP | 2017002384 | A | | 1/2017 |
| JP | 2017524821 | A | | 8/2017 |
| JP | 2017-214647 | A | | 12/2017 |
| JP | 6323617 | B1 | * | 5/2018 |
| JP | 2018090874 | A | | 6/2018 |
| JP | 2020002455 | A | | 1/2020 |
| JP | 2021172838 | A | * | 11/2021 |
| WO | 2016001899 | A1 | | 1/2016 |
| WO | 2017150117 | A1 | | 9/2017 |
| WO | 2017169329 | A1 | | 10/2017 |
| WO | 2017208762 | A1 | | 12/2017 |
| WO | 2020158066 | A1 | | 8/2020 |

OTHER PUBLICATIONS

JP 2021-172838 A machine translation (Year: 2021).*
JP-6323617-B1 machine translation (Year: 2018).*
Office Action (The First Office Action) issued Aug. 1, 2025, by the State Intellectual Property Office of People's Republic of China in corresponding Chinese Patent Application No. 202280027179.2 and an English translation of the Office Action. (12 pages).
Japanese Office Action of Japanese Application No. 2022-544156, issued Sep. 27, 2022, 6 pages.
English Search Report of Japanese Office Action for Japanese Application No. 2022-544156, issued Sep. 27, 2022, 1 page.
English Search Report of Japanese Office Action for Japanese Application No. 2022-544156, issued Jan. 4, 2023, 1 page.
Office Action (Request for the Submission of an Opinion) issued May 9, 2025, by the Korean Intellectual Property Office in corresponding Korean Patent Application No. 10-2023-7033797 and an English translation with the Concise Statement of Relevance of the Office Action. (14 pages).

(Continued)

*Primary Examiner* — Tima M. McGuthry-Banks
(74) *Attorney, Agent, or Firm* — Buchanan Ingersoll & Rooney PC

(57) ABSTRACT

A high-strength cold-rolled steel sheet has a chemical composition containing C: 0.150 to 0.350 mass %, Si: 0.80 to 3.00 mass %, Mn: 1.50 to 3.50 mass %, P: 0.100 mass % or less, S: 0.0200 mass % or less, Al: 0.100 mass % or less, N: 0.0100 mass % or less, and O: 0.0100 mass % or less, with a remaining part consisting of Fe and impurities. The amount of diffusible hydrogen is 0.50 mass ppm or less, the area ratio of tempered martensite and bainite is 55 to 95%, the area ratio of retained austenite is 5 to 30%, a prior austenite grain has an average circle equivalent diameter of 15.0 μm or less, and the ratio b/a is 0.80 or less, where a circumferential length of the prior austenite grain is a, and a circumferential length of a portion of the prior austenite grain having a carbon concentration of 0.6 mass % or more is b.

6 Claims, No Drawings

(56) References Cited

OTHER PUBLICATIONS

The Extended European Search Report issued Jul. 9, 2024, by the European Patent Office in corresponding European Patent Application No. 22 784 374.5-1103. (11 pages).
International Search Report and Written Opinion for International Application No. PCT/JP2022/008708, dated Jun. 7, 2022, 6 pages.
Japanese Office Action of Japanese Application No. 2022544156, issued Jan. 4, 2023, 2 pages.
Japanese Office Action of Japanese Application No. 2022544156, issued Sep. 27, 2023, 6 pages.
Yamashita et al., "Novel technique to suppress hydrocarbon contamination for high accuracy determination of carbon content in steel by FE-EPMA", Scientific Reports, Jul. 19, 2016, 8 pages.

* cited by examiner

HIGH-STRENGTH COLD-ROLLED STEEL SHEET AND METHOD FOR MANUFACTURING SAME

CROSS REFERENCE TO RELATED APPLICATIONS

This is the U.S. National Phase application of PCT/JP2022/008708, filed Mar. 2, 2022, which claims priority to Japanese Patent Application No. 2021-066342, filed Apr. 9, 2021, the disclosures of these applications being incorporated herein by reference in their entireties for all purposes.

FIELD OF THE INVENTION

The present invention relates to a high-strength cold-rolled steel sheet having tensile strength (TS) of 1320 MPa or more and a method for producing the same.

BACKGROUND OF THE INVENTION

In recent years, for example, in the automobile industry, from the viewpoint of preserving the global environment, improvement in the fuel efficiency of an automobile is desired in order to reduce the emission amount of carbon dioxide ($CO_2$).

In order to improve the fuel efficiency of the automobile, it is effective to reduce the weight of a vehicle body, but at this time, it is necessary to reduce the weight of the vehicle body while maintaining the strength of the vehicle body.

For example, Patent Literature 1 discloses a high-strength steel sheet having tensile strength of 980 MPa or more.

PATENT LITERATURE

Patent Literature 1: JP 2017-2384 A

SUMMARY OF THE INVENTION

A high-strength steel sheet having tensile strength of 1320 MPa or more usually contains a large amount of alloy elements necessary for strength enhancement. In a spot welded portion obtained by spot-welding such steel sheets, the toughness of a heat-affected zone around a nugget (melt-solidified zone) is insufficient, and strength (fatigue strength) when stress is repeatedly applied may be insufficient.

If the decrease in the fatigue strength of the spot welded portion can be suppressed, the collision strength of the entire automobile can be sufficiently maintained.

Aspects of the present invention have been made in view of the above points, and an object according to aspects of the present invention is to provide a high-strength cold-rolled steel sheet having tensile strength of 1320 MPa or more and also excellent in fatigue strength of a spot welded portion.

As a result of intensive studies, the present inventors have found that the above object is achieved by adopting the following configuration, and have completed the present invention.

That is, aspects of the present invention include the following [1] to [7].

[1] A high-strength cold-rolled steel sheet comprising:
- a chemical composition containing
  - C in an amount of 0.150 to 0.350 mass %,
  - Si in an amount of 0.80 to 3.00 mass %,
  - Mn in an amount of 1.50 to 3.50 mass %,
  - P in an amount of 0.100 mass % or less,

- S in an amount of 0.0200 mass % or less,
  - Al in an amount of 0.100 mass % or less,
  - N in an amount of 0.0100 mass % or less,
  - O in an amount of 0.0100 mass % or less,
  - with a remaining part consisting of Fe and inevitable impurities; and
- a microstructure,
- wherein an amount of diffusible hydrogen in-steel is 0.50 mass ppm or less,
- tensile strength is 1320 MPa or more, and
- in the microstructure,
  - a total area ratio of tempered martensite and bainite is 55 to 95%,
  - an area ratio of retained austenite is 5 to 30%,
  - a prior austenite grain has an average circle equivalent diameter of 15.0 μm or less, and
  - a ratio b/a is 0.80 or less, where a circumferential length of the prior austenite grain is a, and a circumferential length of a portion of the prior austenite grain having a carbon concentration of 0.6 mass % or more is b.

[2] The high-strength cold-rolled steel sheet according to [1] above,
- wherein the chemical composition further contains at least one element selected from the group consisting of
  - B in an amount of 0.0050 mass % or less,
  - Ti in an amount of 0.200 mass % or less,
  - Nb in an amount of 0.200 mass % or less,
  - V in an amount of 0.500 mass % or less,
  - W in an amount of 0.500 mass % or less,
  - Mo in an amount of 1.000 mass % or less,
  - Cr in an amount of 1.000 mass % or less,
  - Sb in an amount of 0.200 mass % or less,
  - Sn in an amount of 0.200 mass % or less,
  - Zr in an amount of 0.1000 mass % or less,
  - Cu in an amount of 1.000 mass % or less,
  - Ni in an amount of 1.000 mass % or less,
  - Ca in an amount of 0.0050 mass % or less,
  - Mg in an amount of 0.0050 mass % or less,
  - REM in an amount of 0.0050 mass % or less,
  - Co in an amount of 0.30 mass % or less,
  - Ta in an amount of 0.10 mass % or less,
  - Hf in an amount of 0.10 mass % or less,
  - As in an amount of 0.100 mass % or less,
  - Pb in an amount of 0.100 mass % or less,
  - Zn in an amount of 0.100 mass % or less, and
  - Bi in an amount of 0.100 mass % or less.

[3] The high-strength cold-rolled steel sheet according to [1] or [2] above, further comprising a plated layer on a surface of the high-strength cold-rolled steel sheet.

[4] The high-strength cold-rolled steel sheet according to any one of [1] to [3] above, wherein the plated layer is a hot-dip galvanized layer, a hot-dip galvannealed layer, or an electrogalvanized layer.

[5] A method for producing the high-strength cold-rolled steel sheet according to [1] or [2] above, the method comprising:
- hot-rolling a steel slab having the chemical composition according to [1] or [2] above, and coiling a resulting hot-rolled steel sheet at a coiling temperature of 350 to 650° C.;
- cold-rolling the coiled hot-rolled steel sheet to obtain a cold-rolled steel sheet; and
- heating the cold-rolled steel sheet at a heating temperature of 750 to 950° C. for 10 to 500 seconds, followed by cooling at an average cooling rate v1 of 10° C./s or more from the heating temperature to 400° C., cooling at an average cooling rate v2 satisfying a formula (1) from 400° C. to a cooling stop temperature of 130 to 300° C., reheating at a reheating temperature of 200 to 450° C. for 10 to 500 seconds, and then cooling at an average cooling rate v3 satisfying a formula (2) from (Ms point—240) ° C. to 50° C., $$v2 \geq 0.6(2[Mn]+0.8[Si]) \quad (1)$$

$$v3 \leq 2.8[Mn]+2.0[Si] \quad (2)$$

wherein [Mn] and [Si] in the formulae (1) and (2) are respectively contents of Mn and Si in the chemical composition, and a unit of each of the contents is mass %.

[6] The method for producing the high-strength cold-rolled steel sheet according to [5] above, wherein the cold-rolled steel sheet cooled at the average cooling rate v3 is subjected to a plating treatment.

[7] The method for producing the high-strength cold-rolled steel sheet according to [6] above, wherein the plating treatment is a hot-dip galvanizing treatment, a hot-dip galvannealing treatment, or an electrogalvanizing treatment.

According to aspects of the present invention, it is possible to provide a high-strength cold-rolled steel sheet having tensile strength of 1320 MPa or more and also excellent in fatigue strength of a spot welded portion.

DETAILED DESCRIPTION OF EMBODIMENTS OF THE INVENTION

[High-Strength Cold-Rolled Steel Sheet]

A high-strength cold-rolled steel sheet according to aspects of the present invention has a chemical composition and a microstructure described later, and satisfies an amount of diffusible hydrogen in-steel described later.

Hereinafter, the "high-strength cold-rolled steel sheet" is also simply referred to as a "cold-rolled steel sheet" or a "steel sheet".

The sheet thickness of the steel sheet is not particularly limited, and is, for example, 0.5 mm or more and 3.0 mm or less.

The high strength means that tensile strength (TS) is 1320 MPa or more.

The high-strength cold-rolled steel sheet according to aspects of the present invention has tensile strength of 1320 MPa or more, and is also excellent in fatigue strength of a spot welded portion. Therefore, the collision strength of the high-strength cold-rolled steel sheet can be sufficiently maintained, so that the high-strength cold-rolled steel sheet is suitably used for a transport machine such as an automobile.

As a method for forming the high-strength cold-rolled steel sheet according to aspects of the present invention, a general working method such as press working can be used without limitation. As a method for welding the high-strength cold-rolled steel sheet according to aspects of the present invention, a general welding method such as spot welding or arc welding can be used without limitation.

<Chemical Composition>

The chemical composition of the high-strength cold-rolled steel sheet according to aspects of the present invention (hereinafter, also referred to as the "chemical composition according to aspects of the present invention" for convenience) will be described.

"%" in the chemical composition according to aspects of the present invention means "mass %" unless otherwise specified.

<<C: 0.150 to 0.350%>>

C allows generation of martensite to increase the strength of the steel sheet. When the amount of C is too small, the hardness of martensite decreases, and the total area ratio of tempered martensite and bainite decreases, so that tensile strength of 1320 MPa or more cannot be obtained. Therefore, the amount of C is 0.150% or more, preferably 0.180% or more, and more preferably 0.200% or more.

Meanwhile, when the amount of C is too large, a large amount of cementite is generated in a heat-affected zone, and therefore the toughness of the spot welded portion decreases, resulting in a decrease in the fatigue strength of the spot welded portion. C segregating at the grain boundary of prior austenite grains increases, and the value of a ratio (b/a) described later increases, so that the toughness of the spot welded portion decreases. Therefore, the amount of C is 0.350% or less, preferably 0.330% or less, and more preferably 0.310% or less.

<<Si: 0.80 to 3.00%>>

Si increases the strength of the steel sheet by solid solution strengthening. From the viewpoint of obtaining tensile strength of 1320 MPa or more, the amount of Si is 0.80% or more, preferably 1.00% or more, and more preferably 1.10% or more.

Meanwhile, when the amount of Si is too large, the toughness of the spot welded portion decreases, resulting in a decrease in the fatigue strength of the spot welded portion. Therefore, the amount of Si is 3.00% or less, preferably 2.60% or less, and more preferably 2.40% or less.

<<Mn: 1.50 to 3.50%>>

Mn increases the strength of the steel sheet by solid solution strengthening. From the viewpoint of obtaining tensile strength of 1320 MPa or more, the amount of Mn is 1.50% or more, preferably 1.90% or more, and more preferably 2.30% or more.

Meanwhile, when the amount of Mn is too large, a large amount of cementite is generated by tempering, and the toughness of the spot welded portion decreases, resulting in a decrease in the fatigue strength of the spot welded portion. Therefore, the amount of Mn is 3.50% or less, preferably 3.30% or less, and more preferably 3.10% or less.

<<P: 0.100% or Less>>

P segregates at the grain boundary, so that the toughness of the spot welded portion decreases, resulting in a decrease in the fatigue strength of the spot welded portion. Therefore, the amount of P is 0.100% or less, preferably 0.030% or less, and more preferably 0.010% or less.

<<S: 0.0200% or Less>>

S combines with Mn to form coarse MnS, so that the toughness of the spot welded portion decreases, resulting in a decrease in the fatigue strength of the spot welded portion. Therefore, the amount of S is 0.0200% or less, preferably 0.0100% or less, and more preferably 0.0020% or less.

<<Al: 0.100% or Less>>

Al acts as a deoxidizer. When the amount of Al is too large, an oxide or a nitride is coarsened by agglomeration, so that the toughness of the spot welded portion decreases, resulting in a decrease in the fatigue strength of the spot welded portion. Therefore, the amount of Al is 0.100% or less, preferably 0.080% or less, and more preferably 0.060% or less.

The lower limit of the amount of Al is not particularly limited, but is, for example, 0.010%, and preferably 0.020%, from the viewpoint of obtaining the effect of adding Al.

<<N: 0.0100% or Less>>

N combines with Ti to form TiN. If the amount of N is too large, the amount of TiN to be formed increases. Due to this, the toughness of the spot welded portion decreases, resulting in a decrease in the fatigue strength of the spot welded portion. Therefore, the amount of N is 0.0100% or less, preferably 0.0080% or less, and more preferably 0.0060% or less.

<<O: 0.0100% or Less>>

O forms an oxide, so that the toughness of the spot welded portion decreases, resulting in a decrease in the fatigue strength of the spot welded portion. Therefore, the amount of 0 is 0.0100% or less, preferably 0.0050% or less, and more preferably 0.0020% or less.

<<Other Components>>

The chemical composition according to aspects of the present invention may further contain at least one selected from the group consisting of components described below in terms of mass %.

(B: 0.0050% or Less)

B is an element that can improve the hardenability of the steel sheet by segregating at an austenite grain boundary, and is preferably added because B increases the tensile strength of the steel sheet.

However, when the amount of B is too large, Fe 23 (CB) 6 is formed, so that the toughness of the spot welded portion decreases, resulting in a decrease in the fatigue strength of the spot welded portion. Therefore, the amount of B is preferably 0.0050% or less, more preferably 0.0040% or less, and still more preferably 0.0030% or less.

The lower limit of the amount of B is not particularly limited, but is, for example, 0.0005%, and preferably 0.0010%, from the viewpoint of obtaining the effect of adding B.

(Ti: 0.200% or Less)

Ti is preferably added because it increases the tensile strength of the steel sheet by forming a fine carbide, nitride or carbonitride during hot rolling or annealing.

However, when the amount of Ti is too large, Ti is bonded to N to form a coarse nitride, so that the toughness of the spot welded portion decreases, resulting in a decrease in the fatigue strength of the spot welded portion. Therefore, the amount of Ti is preferably 0.200% or less, more preferably 0.100% or less, and still more preferably 0.050% or less.

The lower limit of the amount of Ti is not particularly limited, but is, for example, 0.005%, and preferably 0.010%, from the viewpoint of obtaining the effect of adding Ti.

(Nb: 0.200% or Less, V: 0.500% or Less, W: 0.500% or Less)

Nb, V and W are preferably added because they increase the tensile strength of the steel sheet by forming a fine carbide, nitride or carbonitride during hot rolling or annealing.

However, when the amounts of these elements are excessively large, the elements remain as coarse carbides without being dissolved during steel slab heating. The coarse carbides decrease the toughness of the spot welded portion, resulting in a decrease in the fatigue strength of the spot welded portion.

Therefore, the amount of Nb is preferably 0.200% or less, more preferably 0.100% or less, and still more preferably 0.050% or less. The lower limit of the amount of Nb is not particularly limited, but is, for example, 0.005%, and preferably 0.010%, from the viewpoint of obtaining the effect of adding Nb.

The amount of V is preferably 0.500% or less, more preferably 0.300% or less, and still more preferably 0.100% or less. The lower limit of the amount of V is not particularly limited, but is, for example, 0.005%, and preferably 0.010%, from the viewpoint of obtaining the effect of adding V.

The amount of W is preferably 0.500% or less, more preferably 0.200% or less, and still more preferably 0.050% or less. The lower limit of the amount of W is not particularly limited, but is, for example, 0.001%, and preferably 0.002%, from the viewpoint of obtaining the effect of adding W.

(Mo: 1.000% or Less, Cr: 1.000% or Less)

Mo and Cr are preferably added because they increase the tensile strength of the steel sheet by increasing the hardenability of the steel sheet. However, when the amounts of these elements are excessively large, hard martensite is excessively generated, so that the toughness of the spot welded portion decreases, resulting in a decrease in the fatigue strength of the spot welded portion.

Therefore, the amount of Mo is preferably 1.000% or less, more preferably 0.700% or less, and still more preferably 0.400% or less. The lower limit of the amount of Mo is not particularly limited, but is, for example, 0.005%, and preferably 0.020%, from the viewpoint of obtaining the effect of adding Mo.

The amount of Cr is preferably 1.000% or less, more preferably 0.700% or less, and still more preferably 0.400% or less. The lower limit of the amount of Cr is not particularly limited, but is, for example, 0.005%, and preferably 0.020%, from the viewpoint of obtaining the effect of adding Cr.

(Sb: 0.200% or Less, Sn: 0.200% or Less)

Sb and Sn are preferably added because they increase the tensile strength of the steel sheet by suppressing the decarburization of the surface of the steel sheet. However, when the amounts of these elements are excessively large, the steel becomes brittle, so that cracks are generated in the heat-affected zone, resulting in a decrease in the fatigue strength of the spot welded portion.

Therefore, the amount of Sb is preferably 0.200% or less, more preferably 0.080% or less, and still more preferably 0.040% or less. The lower limit of the amount of Sb is not particularly limited, but is, for example, 0.001%, and preferably 0.002%, from the viewpoint of obtaining the effect of adding Sb.

The amount of Sn is preferably 0.200% or less, more preferably 0.080% or less, and still more preferably 0.040% or less. The lower limit of the amount of Sn is not particularly limited, but is, for example, 0.001%, and preferably 0.002%, from the viewpoint of obtaining the effect of adding Sn.

(Zr: 0.1000% or Less)

Zr is preferably added because it spheroidizes the shape of the precipitate to increase the toughness of the spot welded portion. However, when the amount of Zr is excessively large, a coarse precipitate remaining as a non-solid solution at the time of heating the steel slab in hot rolling increases, so that the toughness of the spot welded portion decreases, resulting in a decrease in the fatigue strength of the spot welded portion.

Therefore, the amount of Zr is preferably 0.1000% or less, more preferably 0.0700% or less, and still more preferably 0.0400% or less. The lower limit of the amount of Zr is not particularly limited, but is, for example, 0.0005%, and preferably 0.0010%, from the viewpoint of obtaining the effect of adding Zr.

(Cu: 1.000% or Less)

Cu is preferably added because it increases the tensile strength of the steel sheet by increasing the hardenability of the steel sheet. However, when the amount of Cu is excessively large, the toughness of the spot welded portion decreases due to an increase in the amount of a Cu inclusion, resulting in a decrease in the fatigue strength of the spot welded portion.

Therefore, the amount of Cu is preferably 1.000% or less, more preferably 0.700% or less, and still more preferably 0.400% or less. The lower limit of the amount of Cu is not particularly limited, but is, for example, 0.005%, and preferably 0.010%, from the viewpoint of obtaining the effect of adding Cu.

(Ni: 1.000% or Less)

Ni is preferably added because it increases the tensile strength of the steel sheet by increasing the hardenability of the steel sheet. However, when the amount of Ni is excessively large, the toughness of the spot welded portion decreases due to an increase in hard martensite, resulting in a decrease in the fatigue strength of the spot welded portion.

Therefore, the amount of Ni is preferably 1.000% or less, more preferably 0.700% or less, and still more preferably 0.400% or less. The lower limit of the amount of Ni is not particularly limited, but is, for example, 0.003%, and preferably 0.005%, from the viewpoint of obtaining the effect of adding Ni.

(Ca: 0.0050% or Less, Mg: 0.0050% or Less, REM: 0.0050% or Less)

Ca, Mg, and rare earth metal (REM) are preferably added because they spheroidize the shape of a precipitate such as a sulfide or an oxide to increase the toughness of spot welded portion. However, when the amounts of these elements are excessively large, the toughness of the spot welded portion decreases due to the coarsening of the sulfide, resulting in a decrease in the fatigue strength of the spot welded portion.

Therefore, the amount of Ca is preferably 0.0050% or less, more preferably 0.0045% or less, and still more preferably 0.0040% or less. The lower limit of the amount of Ca is not particularly limited, but is, for example, 0.0005%, and preferably 0.0010%, from the viewpoint of obtaining the effect of adding Ca.

The amount of Mg is preferably 0.0050% or less, more preferably 0.0048% or less, and still more preferably 0.0045% or less. The lower limit of the amount of Mg is not particularly limited, but is, for example, 0.0005%, and preferably 0.0010%, from the viewpoint of obtaining the effect of adding Mg.

The amount of REM is preferably 0.0050% or less, more preferably 0.0040% or less, and still more preferably 0.0030% or less. The lower limit of the amount of REM is not particularly limited, but is, for example, 0.0005%, and preferably 0.0010%, from the viewpoint of obtaining the effect of adding REM.

(Co: 0.30% or Less)

Co is preferably added because it spheroidizes the shape of the precipitate to increase the toughness of the spot welded portion. However, when the amount of Co is excessively large, the toughness of the spot welded portion decreases due to an increase in hard martensite, resulting in a decrease in the fatigue strength of the spot welded portion.

Therefore, the amount of Co is preferably 0.30% or less, more preferably 0.20% or less, and still more preferably 0.10% or less. The lower limit of the amount of Co is not particularly limited, but is, for example, 0.01%, and preferably 0.02%, from the viewpoint of obtaining the effect of adding Co.

(Ta: 0.10% or Less)

Ta is preferably added because it spheroidizes the shape of the precipitate to increase the toughness of the spot welded portion. However, when the amount of Ta is excessively large, the toughness of the spot welded portion decreases due to an increase in a coarse carbide, resulting in a decrease in the fatigue strength of the spot welded portion.

Therefore, the amount of Ta is preferably 0.10% or less, more preferably 0.08% or less, and still more preferably 0.06% or less. The lower limit of the amount of Ta is not particularly limited, but is, for example, 0.01%, and preferably 0.02%, from the viewpoint of obtaining the effect of adding Ta.

(Hf: 0.10% or Less)

Hf is preferably added because it spheroidizes the shape of the precipitate to increase the toughness of the spot welded portion. However, when the amount of Hf is excessively large, the toughness of the spot welded portion decreases due to an increase in a coarse carbide, resulting in a decrease in the fatigue strength of the spot welded portion.

Therefore, the amount of Hf is preferably 0.10% or less, more preferably 0.08% or less, and still more preferably 0.06% or less. The lower limit of the amount of Hf is not particularly limited, but is, for example, 0.01%, and preferably 0.02%, from the viewpoint of obtaining the effect of adding Hf.

(As: 0.100% or Less, Pb: 0.100% or Less, Zn: 0.100% or Less, and Bi: 0.100% or Less)

As, Pb, Zn and Bi are preferably added because they spheroidize the shape of the precipitate to increase the toughness of the spot welded portion. However, when the amounts of these elements are excessively large, a large amount of coarse precipitates and inclusions are generated, so that the toughness of the spot welded portion decreases, resulting in a decrease in the fatigue strength of the spot welded portion.

Therefore, the amount of As is preferably 0.100% or less, more preferably 0.050% or less, and still more preferably 0.010% or less. The lower limit of the amount of As is not particularly limited, but is, for example, 0.001%, and preferably 0.002%, from the viewpoint of obtaining the effect of adding As.

The amount of Pb is preferably 0.100% or less, more preferably 0.050% or less, and still more preferably 0.010% or less. The lower limit of the amount of Pb is not particularly limited, but is, for example, 0.001%, and preferably 0.002%, from the viewpoint of obtaining the effect of adding Pb.

The amount of Zn is preferably 0.100% or less, more preferably 0.050% or less, and still more preferably 0.010% or less. The lower limit of the amount of Zn is not particularly limited, but is, for example, 0.001%, and preferably 0.002%, from the viewpoint of obtaining the effect of adding Zn.

The amount of Bi is preferably 0.100% or less, more preferably 0.050% or less, and still more preferably 0.010% or less. The lower limit of the amount of Bi is not particularly limited, but is, for example, 0.001%, and preferably 0.002%, from the viewpoint of obtaining the effect of adding Bi.

<<Remaining Part: Fe and Inevitable Impurities>>

The remaining part in the chemical composition according to aspects of the present invention consists of Fe and inevitable impurities.

<Microstructure>

Next, the microstructure of the high-strength cold-rolled steel sheet according to aspects of the present invention (hereinafter, also referred to as "microstructure according to aspects of the present invention" for convenience) will be described.

In order to obtain the effect of aspects of the present invention, it is insufficient to merely satisfy the chemical composition according to aspects of the present invention described above, and it is necessary to satisfy the microstructure according to aspects of the present invention described below.

Hereinafter, an area ratio is an area ratio with respect to the entire microstructure. The area ratio of each structure is determined by a method described in Examples described later.

<<Total Area Ratio of Tempered Martensite and Bainite: 55 to 95%>>

From the viewpoint of stably securing tensile strength of 1320 MPa or more, the total area ratio of tempered martensite and bainite is 55% or more, preferably 58% or more, and more preferably 60% or more.

Meanwhile, when the total area ratio is too high, the area ratio of retained austenite decreases, resulting in a decrease in the ductility of the steel sheet. Therefore, the total area ratio is 95% or less, preferably 92% or less, and more preferably 88% or less.

<<Area Ratio of Retained Austenite: 5 to 30%>>

Retained austenite improves the ductility of the steel sheet. Therefore, the area ratio of retained austenite is 5% or more, preferably 6% or more, and more preferably 8% or more.

Meanwhile, if the area ratio of retained austenite is too high, retained austenite that undergoes martensitic transformation when subjected to stress increases, so that cracks are generated in the heat-affected zone, resulting in a decrease in the fatigue strength of the spot welded portion. Therefore, the area ratio of retained austenite is 30% or less, preferably 20% or less, and more preferably 18% or less.

The microstructure according to aspects of the present invention may contain known structures such as pearlite; fresh martensite; ferrite; iron-based carbonitride; alloy carbonitride; and inclusions such as MnS and $Al_2O_3$, as a structure (remaining part structure) other than tempered martensite, bainite and retained austenite.

The area ratio of the remaining part structure is preferably 35% or less, more preferably 25% or less, and still more preferably 15% or less. When the area ratio of the remaining part structure is within this range, the effect according to aspects of the present invention is not impaired.

<<Average Circle Equivalent Diameter of Prior Austenite Grains: 15.0 μm or Less>>

When the prior austenite grain size becomes coarse, the toughness of the spot welded portion decreases, resulting in a decrease in the fatigue strength of the spot welded portion. Therefore, the average circle equivalent diameter of the prior austenite grains is 15.0 μm or less, preferably 14.0 μm or less, and more preferably 13.0 μm or less.

The lower limit of the average circle equivalent diameter is not particularly limited, and is, for example, 2.0 μm, and preferably 4.0 μm.

The average circle equivalent diameter of the prior austenite grains is determined by a method described in Examples described later.

<<Ratio (b/a): 0.80 or Less>>

A region having a high carbon concentration and being present on the grain boundary of the prior austenite grains (the structure or the like in this region is not particularly limited) is harder than the adjacent structure. When stress is repeatedly applied to the spot welded portion, voids are generated in the heat-affected zone due to the difference in hardness, resulting in a decrease in the fatigue strength of the spot welded portion.

Therefore, when the circumferential length of the prior austenite grain is a and the length of a circumferential portion having a carbon concentration of 0.6 mass % or more in the prior austenite grain is b, a smaller value of the ratio (b/a) of b to a is preferred.

Specifically, the ratio (b/a) is 0.80 or less, preferably 0.76 or less, and more preferably 0.72 or less.

The lower limit of the ratio (b/a) is not particularly limited, and is, for example, 0.20, and preferably 0.30.

The ratio (b/a) is obtained by a method described in Examples described later.

<Amount of Diffusible Hydrogen In-Steel: 0.50 Mass ppm or Less>

If the amount of diffusible hydrogen in-steel is too large, the spot welded portion is easily cracked during welding, resulting in a decrease in the fatigue strength of the spot welded portion. Therefore, the amount of diffusible hydrogen in-steel is 0.50 mass ppm or less, preferably 0.30 mass ppm or less, and more preferably 0.20 mass ppm or less.

The amount of diffusible hydrogen in-steel is determined by a method described in Examples described later.

<Plated Layer>

The high-strength cold-rolled steel sheet according to aspects of the present invention may further include a plated layer on the surface thereof from the viewpoint of improving corrosion resistance and the like. Examples of the plated layer include a hot-dip galvanized layer, a hot-dip galvannealed layer, or an electrogalvanized layer. The plated layer is formed by a plating treatment described later.

[Method for Producing High-Strength Cold-Rolled Steel Sheet]

Next, a method for producing a high-strength cold-rolled steel sheet according to aspects of the present invention (hereinafter, also referred to as "production method according to aspects of the present invention" for convenience) will be described. The production method according to aspects of the present invention is also a method for producing the high-strength cold-rolled steel sheet according to aspects of the present invention described above.

A temperature at the time of heating or cooling a steel slab or a steel sheet or the like described below means the surface temperature of the steel slab or the steel sheet or the like unless otherwise specified.

A method for smelting the steel slab (steel material) is not particularly limited, and a known smelting method such as a converter or an electric furnace can be adopted. After smelting, it is preferable to obtain the steel slab by a continuous casting method. However, the steel slab may be obtained using other known casting methods such as an ingot casting-blooming method and a thin slab continuous casting method.

In the production method according to aspects of the present invention, first, a steel slab having the above-described chemical composition is hot-rolled. Thus, a hot-rolled steel sheet is obtained.

In hot rolling, the steel slab may be rolled after being reheated in a heating furnace. When the steel slab holds a temperature equal to or higher than a predetermined temperature, the steel slab may be directly rolled without being heated.

In hot rolling, the steel slab is subjected to rough rolling and finish rolling.

Before the rough rolling, it is preferred to heat the steel slab to dissolve a carbide in the steel slab.

From the viewpoint of dissolving the carbide and preventing an increase in a rolling load, a temperature (steel slab heating temperature) when heating the steel slab is preferably 1100° C. or higher, and more preferably 1150° C. or higher.

Meanwhile, from the viewpoint of preventing an increase in scale loss, the steel slab heating temperature is preferably 1300° C. or lower, and more preferably 1280° C. or lower.

As described above, when the steel slab before the rough rolling maintains a temperature equal to or higher than a predetermined temperature and the carbide in the steel slab is dissolved, heating of the steel slab before the rough rolling can be omitted.

The conditions of the rough rolling and the finish rolling are not particularly limited, but for example, a finish rolling end temperature is preferably 700 to 1100° C., and more preferably 800 to 1000° C.

<Coiling Temperature: 350 to 650° C.>

Next, the hot-rolled steel sheet obtained by hot-rolling the steel slab is coiled.

When a temperature (coiling temperature) at which the hot-rolled steel sheet is coiled is too low, hard martensite is generated, resulting in an increase in a rolling load in the subsequent cold rolling, so that the productivity of the hot-rolled steel sheet decreases. Martensite having a high carbon concentration increases on the grain boundary of the prior austenite grains, resulting in an increase in the value of the ratio (b/a) described above, so that the fatigue strength of the spot welded portion decreases.

Therefore, the coiling temperature is 350° C. or higher, preferably 360° C. or higher, and more preferably 370° C. or higher.

Meanwhile, when the coiling temperature is too high, the prior austenite grain size becomes coarse, so that the toughness of the spot welded portion decreases, resulting in a decrease in the fatigue strength of the spot welded portion.

Therefore, the coiling temperature is 650° C. or lower, preferably 630° C. or lower, and more preferably 600° C. or lower.

Next, the coiled hot-rolled steel sheet is cold-rolled to obtain a cold-rolled steel sheet.

The rolling reduction of the cold rolling is preferably 30% or more, and more preferably 35% or more. The upper limit of the rolling reduction is not particularly limited, and is, for example, 70% or less, and preferably 65% or less.

<Heating Temperature: 750 to 950° C., Heating Time: 10 to 500 Seconds>

Next, the cold-rolled steel sheet obtained by the cold rolling is subjected to a heat treatment.

Specifically, first, the cold-rolled steel sheet is heated.

At this time, when the heating temperature of the cold-rolled steel sheet is too low or the heating time (holding time at the heating temperature) is too short, heating is performed in a two-phase region of ferrite and austenite; thus, the final microstructure contains ferrite, and the total area ratio of tempered martensite and bainite decreases, so that it is difficult to secure desired tensile strength.

Therefore, the heating temperature is 750° C. or higher, preferably 800° C. or higher, and more preferably 850° C. or higher. The heating time is 10 seconds or more, preferably 50 seconds or more, and more preferably 80 seconds or more.

Meanwhile, when the heating temperature is too high, the prior austenite grain size becomes coarse, so that the toughness of the spot welded portion decreases, resulting in a decrease in the fatigue strength of the spot welded portion. In addition, since the amount of hydrogen entering the steel increases due to an increase in a high hydrogen partial pressure, the amount of diffusible hydrogen in-steel increases.

When the heating time is too long, the prior austenite grain size is coarsened, so that the toughness of the spot welded portion decreases, resulting in a decrease in the fatigue strength of the spot welded portion.

Therefore, the heating temperature is 950° C. or lower, preferably 930° C. or lower, and more preferably 900° C. or lower. The heating time is 500 seconds or less, preferably 300 seconds or less, and more preferably 200 seconds or less.

<Average Cooling Rate v1: 10° C./s or More>

Next, the heated cold-rolled steel sheet is cooled from the heating temperature to a cooling stop temperature described later.

Here, an average cooling rate from the heating temperature to 400° C. is defined as v1.

If the average cooling rate v1 is too low, ferrite transformation occurs during cooling, and the total area ratio of tempered martensite and bainite decreases, so that it is difficult to ensure desired tensile strength. Therefore, the average cooling rate v1 is 10° C./s or more, preferably 11° C./s or more, and more preferably 13° C./s or more.

The upper limit of the average cooling rate v1 is not particularly limited, and is, for example, 45° C./s, and preferably 30° C./s.

<Average Cooling Rate v2: v2≥0.6(2[Mn]+0.8[Si])>

An average cooling rate from 400° C. to the cooling stop temperature is defined as v2.

In the production method according to aspects of the present invention, the average cooling rate v2 satisfies the following formula (1).

$$v2 \geq 0.6(2[Mn]+0.8[Si]) \quad (1)$$

In the formula (1), [Mn] and [Si] are respectively the contents (unit: mass %) of Mn and Si in the chemical composition described above (chemical composition according to aspects of the present invention).

If the average cooling rate v2 does not satisfy the formula (1), austenite present during cooling cannot be transformed into martensite, so that tempered martensite in the final microstructure decreases. As a result, the total area ratio of tempered martensite and bainite decreases, so that tensile strength of 1320 MPa or more cannot be obtained.

The upper limit of the average cooling rate v2 is not particularly limited, and is, for example, 40° C./s, and preferably 35° C./s.

<Cooling Stop Temperature: 130 to 300° C.>

If the cooling stop temperature is too low, martensite having a high carbon concentration increases on the grain boundary of the prior austenite grains, and the value of the ratio (b/a) described above increases, so that the fatigue strength of the spot welded portion decreases.

Therefore, the cooling stop temperature is 130° C. or higher, preferably 140° C. or higher, and more preferably 150° C. or higher.

Meanwhile, if the cooling stop temperature is too high, retained austenite that undergoes martensitic transformation when subjected to stress increases, cracks occur in the heat-affected zone, resulting in a decrease in the fatigue strength of the spot welded portion. Therefore, the cooling stop temperature is 300° C. or lower, preferably 290° C. or lower, and more preferably 280° C. or lower.

<Reheating Temperature: 200 to 450° C., Reheating Time: 10 to 500 Seconds>

Next, the cold-rolled steel sheet cooled to the cooling stop temperature is reheated.

At this time, when the reheating temperature of the cold-rolled steel sheet is too low or the reheating time (holding time at the reheating temperature) is too short, martensite having a high carbon concentration increases on the grain boundary of the prior austenite grains, and the value of the ratio (b/a) described above increases, so that the fatigue strength of the spot welded portion decreases. In addition, since the diffusible hydrogen in-steel hardly escapes, the amount of the diffusible hydrogen in-steel increases.

Therefore, the reheating temperature is 200° C. or higher, preferably 250° C. or higher, and more preferably 270° C. or higher. The reheating time is 10 seconds or more, preferably 30 seconds or more, and more preferably 50 seconds or more.

Meanwhile, when the reheating temperature is too high, a large amount of iron carbide is precipitated in tempered martensite, so that the tensile strength decreases, and the toughness of the spot welded portion decreases, resulting in a decrease in the fatigue strength of the spot welded portion.

When the reheating time is too long, carbon solid-solved in a supersaturated state in martensite diffuses into austenite, so that martensite having a high carbon concentration is likely to be generated. As a result, the value of the ratio (b/a) described above increases, resulting in a decrease in the fatigue strength of the spot welded portion. Furthermore, due to the precipitation of a large amount of iron carbide, the tensile strength decreases, and the toughness of the spot welded portion decreases, resulting in a decrease in the fatigue strength of the spot welded portion.

Therefore, the reheating temperature is 450° C. or lower, preferably 380° C. or lower, and more preferably 350° C. or lower. The reheating time is 500 seconds or less, preferably 300 seconds or less, and more preferably 260 seconds or less.

The reheating temperature may be maintained at a constant temperature or may fluctuate as long as it is within the above temperature range.

<Average Cooling Rate v3: v3≤2.8[Mn]+2.0[Si]>

Next, the reheated cold-rolled steel sheet is cooled from the reheating temperature to at least 50° C.

In this cooling (also referred to as "recooling"), an average cooling rate from (Ms point—240) ° C. to 50° C. is defined as v3.

In the production method according to aspects of the present invention, the average cooling rate v3 satisfies the following formula (2).

$$v3 \leq 2.8[Mn]+2.0[Si] \quad (2)$$

In the formula (2), [Mn] and [Si] are respectively the contents (unit: mass %) of Mn and Si in the chemical composition described above (chemical composition according to aspects of the present invention).

When the average cooling rate v3 satisfies the formula (2), martensite generated during recooling is self-tempered, and a fine carbide is generated in the martensite. As a result, the value of the ratio (b/a) described above can be reduced.

The lower limit of the average cooling rate v3 is not particularly limited, and is, for example, 1° C./s, and preferably 2° C./s.

The Ms point (unit: ° C.) is obtained from the following formula (3).

$$Ms=550-350\times[C]-40\times[Mn]-35\times[V]-20\times[Cr]-17\times[Ni]-10\times[Cu]-10\times[Mo]-5\times[W]+15\times[Co]+30\times[Al] \quad (3)$$

In the formula (3), [X] is the content (unit: mass %) of an element X in the chemical composition (chemical composition according to aspects of the present invention) described above.

In the production method according to aspects of the present invention, a plated layer may be formed on the surface of the recooled cold-rolled steel sheet by a plating treatment. Examples of the plated layer include a hot-dip galvanized layer, a hot-dip galvannealed layer, or an electrogalvanized layer.

The plating treatment is preferably a hot-dip galvanizing treatment, a hot-dip galvannealing treatment, or an electrogalvanizing treatment.

When the hot-dip galvanizing treatment is performed, a device configured to be able to continuously perform the heat treatment described above and the hot-dip galvanizing treatment may be used.

When the hot-dip galvanizing treatment is performed, for example, the steel sheet is immersed in a zinc bath having a bath temperature of 440 to 500° C. to perform the hot-dip galvanizing treatment. Thereafter, it is preferable to adjust the adhesion amount of the plated layer by gas wiping or the like.

The zinc bath preferably has a chemical composition having an Al content of 0.10 to 0.23 mass %, with a remaining part consisting of Zn and inevitable impurities.

When the hot-dip galvannealing treatment is performed, and an alloying temperature is too low, a Zn—Fe alloying rate is excessively slow, so that alloying may be significantly difficult. Meanwhile, if the alloying temperature is too high, untransformed austenite is transformed into pearlite, so that the tensile strength and ductility of the steel sheet may decrease. Therefore, the alloying temperature is preferably 450 to 600° C., more preferably 470 to 550° C., and still more preferably 470 to 530° C.

When the electrogalvanizing treatment is performed, a device configured to be able to continuously perform the heat treatment described above and the electrogalvanizing treatment may be used.

An electrogalvanized layer is formed by performing the electrogalvanizing treatment.

The electrogalvanized layer is not particularly limited, and a conventionally known electrogalvanized layer is suitably used. The electrogalvanized layer may be a zinc alloy plated layer in which an element such as Fe, Cr, Ni, Mn, Co, Sn, Pb, or Mo is added to Zn in an appropriate amount according to the purpose.

The adhesion amount of the plated layer of each of a hot-dip galvanized steel sheet (GI), a hot-dip galvannealed steel sheet (GA), and an electrogalvanized steel sheet (EG) is preferably 20 to 80 g/m 2 per one surface (double-sided plating).

The steel sheet subjected to the plating treatment is cooled to, for example, a temperature of 50° C. or lower. The steel sheet cooled to a temperature of 50° C. or lower may be rolled at an elongation rate of 0.05 to 1.00%. The elongation rate of the rolling is preferably 0.08 to 0.70%.

The rolling may be performed with a device continuous with to a device (plating device) for performing the above-described galvanizing treatment, or may be performed with a device separated from the plating device. The rolling may be performed once to achieve a desired elongation rate or multiple times to achieve a desired elongation rate in total.

The rolling described herein typically refers to temper rolling, but may be rolling by a method such as processing with a leveler as long as it can provide an elongation rate equivalent to that of the temper rolling.

In the above-described production method according to aspects of the present invention, for example, a holding temperature such as the heating temperature or the reheating temperature may not be constant as long as it is within the above-described temperature range. The cooling rate may change during cooling as long as it is within the rate range described above. The heat treatment may be performed in any facility as long as the conditions such as the temperature range described above are satisfied.

EXAMPLES

Hereinafter, aspects of the present invention will be specifically described with reference to Examples. However, the present invention is not limited to Examples described below.

<Production of Steel Sheet>

Molten steels having chemical compositions shown in Tables 1 and 2 below (Table 2 is continuous with Table 1) with a remaining part consisting of Fe and inevitable impurities were smelted in a converter, and steel slabs were obtained by a continuous casting method. Underlines in Tables 1 and 2 below mean being outside the scope of the present invention (the same applies to other Tables).

The obtained steel slabs were hot-rolled under the conditions shown in the following Table 3 to obtain hot-rolled steel sheets. Specifically, the steel slabs were heated to 1250° C. and rough-rolled. Next, finish rolling was performed at a finish rolling end temperature of 900° C., and coiling was performed at a coiling temperature shown in Table 3 below.

The coiled hot-rolled steel sheets were cold-rolled at rolling reductions shown in Table 3 below to obtain cold-rolled steel sheets.

The obtained cold-rolled steel sheets were subjected to a heat treatment under the conditions shown in Table 3 below.

In some examples, both the surfaces of the cold-rolled steel sheet (CR) after the heat treatment were subjected to a plating treatment to obtain a hot-dip galvanized steel sheet (GI), a hot-dip galvannealed steel sheet (GA) or an electrogalvanized steel sheet (EG).

As a hot-dip galvanizing bath, a zinc bath containing Al in an amount of 0.20 mass % with a remaining part consisting of Zn and inevitable impurities was used in the case of producing the GI, and a zinc bath containing Al in an amount of 0.14 mass % with a remaining part consisting of Zn and inevitable impurities was used in the case of producing the GA.

A bath temperature was set to 470° C. in both cases of producing the GI and the GA.

The adhesion amount of a plated layer was 45 to 72 g/m 2 per one surface in the case of producing the GI, and 45 g/m 2 per one surface in the case of producing the GA.

When the GA was produced, an alloying temperature was set to 500° C.

The composition of the plated layer of the GI was a composition containing Fe in an amount of 0.1 to 1.0 mass % and Al in an amount of 0.2 to 1.0 mass %, with a remaining part consisting of Fe and inevitable impurities. The composition of the plated layer of the GA was a composition containing Fe in an amount of 7 to 15 mass % and Al in an amount of 0.1 to 1.0 mass %, with a remaining part consisting of Fe and inevitable impurities.

In the production of the EG, an electrogalvanizing treatment was performed using an electrogalvanizing line such that the adhesion amount of the plated layer was 30 g/m 2 per one surface.

Hereinafter, the cold-rolled steel sheet (CR), the hot-dip galvanized steel sheet (GI), the hot-dip galvannealed steel sheet (GA), and the electrogalvanized steel sheet (EG) after the heat treatment are also simply referred to as "steel sheets".

<Observation of Microstructure>

The microstructure of the obtained steel sheet was observed as follows. The results are shown in the following Table 4.

<<Total Area Ratio of Tempered Martensite and Bainite>>

The obtained steel sheet was polished such that a cross section (L cross section) parallel to a rolling direction was an observation surface. The observation surface was corroded using 1% by volume nital, and then observed at a magnification of 3000 times using a scanning electron microscope (SEM). Ten fields were observed from the surface of the steel sheet to the L cross section at a position corresponding to ¼ of a sheet thickness to obtain SEM images.

For the obtained SEM images, the area ratio of each structure was determined, and the average area ratio of the ten fields was taken as the area ratio of each structure. For the analysis of the SEM image, Image-Pro manufactured by Media Cybernetics was used as analysis software.

In the SEM image, for example, tempered martensite and bainite are considered to exhibit a dark gray color. Dark gray color portions were determined as tempered martensite and bainite.

<<Area Ratio of Retained Austenite>>

For retained austenite, a volume ratio was determined by an X-ray diffraction method as follows, and the volume ratio was regarded as an area ratio.

First, the steel sheet was mechanically ground to a position corresponding to ¼ of a sheet thickness in a sheet thickness direction (depth direction), and then chemically polished using oxalic acid to obtain an observation surface. This observation surface was observed by an X-ray diffraction method. As incident X-rays, a Kα radiation source of Co was used. The ratio of the diffraction intensity of each of faces (200), (220), and (311) of fcc iron (austenite) to the diffraction intensity of each of faces (200), (211), and (220) of bcc iron was determined. The obtained ratio was taken as the volume ratio of retained austenite.

<<Average Circle Equivalent Diameter of Prior Austenite Grains>>

The average circle equivalent diameter of prior austenite grains was determined as follows in accordance with JIS G 0551.

First, the obtained steel sheet was polished such that a cross section (L cross section) parallel to a rolling direction was an observation surface. The observation surface was corroded using a picric acid corrosion solution, and then observed at a magnification of 1000 times using a SEM. Ten fields were observed from the surface of the steel sheet to the L cross section at a position corresponding to ¼ of a sheet thickness to obtain SEM images.

For the obtained SEM images, the prior austenite grains were identified, and the areas thereof were determined. From the obtained areas, the circle equivalent diameters of the prior austenite grains were obtained. The average value of the ten fields was taken as the average circle equivalent diameter of the prior austenite grains.

<<Ratio b/a>>

First, the obtained steel sheet was polished using a diamond paste such that a cross section (L cross section) parallel to a rolling direction was an observation surface. The observation surface was finished to a mirror surface by alumina polishing, and then cleaned using a plasma cleaner to eliminate hydrocarbon contamination (carbon contamination, hereinafter referred to as "contamination") on the observation surface.

The cleaned observation surface was measured using a field emission electron probe micro analyzer (FE-EPMA) equipped with a field emission electron gun, to acquire data for obtaining an element mapping image. The measurement conditions had an acceleration voltage of 7 kV and a current of 50 nA according to Non-Patent Literature (T. Yamashita, Y. Tanaka, M. Nagoshi and K. Ishida: Sci. Rep., 6 (2016), DOI: 10.1038/srep 29825). At this time, the steel sheet as a sample was heated and held at 100° C., and measurement was performed under the conditions where contamination did not occur. The measured data was converted to a carbon concentration by a calibration method to obtain an element mapping image of carbon. In the obtained element mapping image, a region having a carbon concentration of 0.6 mass % or more (referred to as a "high carbon region" for convenience) was specified.

More specifically, with reference to the SEM image of the same field as that of the element mapping image, the prior austenite grains were identified, and the high carbon region present on the grain boundary of the prior austenite grains was identified.

Then, the circumferential length (a) of the prior austenite grain and the length (b) of a circumferential portion of the prior austenite grain overlapping the high carbon region were obtained, and a ratio (b/a) was calculated.

Each steel sheet was subjected to surface analysis by EPMA 30 times. The average value of the 30 measured values was taken as the value of the ratio (b/a) in the steel sheet.

<Evaluation>

The obtained steel sheet was evaluated by the following method. The results are shown in the following Table 4.

<<Tensile Test>>

From the obtained steel sheet, a No. 5 test piece described in JIS Z 2201 in which a direction 90° to a rolling direction was taken as a longitudinal direction (tensile direction) was collected. Using the collected test piece, a tensile test in accordance with JIS Z 2241 was performed 5 times, and tensile strength (TS) and butt elongation (EL) were determined from the average value of the 5 measured values.

<<Measurement of Amount of Diffusible Hydrogen In-Steel>>

A test piece having a length of 30 mm and a width of 5 mm was collected from the obtained steel sheet. For the collected test piece, an amount of diffusible hydrogen in-steel was measured by a thermal desorption analysis method. A heating rate was set to 200° C./hr. The cumulative value of amounts of hydrogen detected in a temperature range of room temperature (25° C.) to a temperature lower than 210° C. was taken as the amount of diffusible hydrogen in-steel (unit: mass ppm).

The steel sheet on which the plated layer was formed was measured in the same manner after the plated layer was removed using a router (precision grinder).

<<Fatigue Test of Spot Welded Portion>>

Using the obtained steel sheet, a cross tensile test piece including a spot welded portion was prepared according to JIS Z 3138, and subjected to a fatigue test.

First, spot welding was performed under the conditions of electrode: DR 6 mm-40 R, pressing force: 4802 N (490 kgf), and energization time: 17 cycles, and a current value was adjusted such that a nugget diameter was 6.5 mm to prepare the cross tensile test piece.

A load was applied under the conditions of a minimum maximum load ratio of 0.05, a frequency of 20 Hz, and a number of repetitions of $10^7$ times, and then a cross tensile test was performed at a tensile speed of 5 ram/min. The fatigue strength of the spot welded portion was evaluated from maximum cross tensile strength at which no peeling of the test piece occurred.

Specifically, "Excellent" when cross tensile strength was 250 N or more, "Good" when the cross tensile strength was 180 N or more and less than 250 N, and "Poor" when the cross tensile strength was less than 180 N are shown in the following Table 4.

In the case of "Excellent" or "Good", the fatigue strength of the spot welded portion can be evaluated to be excellent.

TABLE 1

| Steel | Chemical composition [mass %] | | | | | | | | | | | | | | |
|---|---|---|---|---|---|---|---|---|---|---|---|---|---|---|---|
| symbol | C | Si | Mn | P | S | Al | N | O | B | Ti | Nb | V | W | Mo | Cr |
| A | 0.230 | 1.21 | 2.89 | 0.006 | 0.0005 | 0.041 | 0.0040 | 0.0006 | 0.0016 | 0.023 | 0.022 | — | — | — | — |
| B | 0.322 | 1.52 | 3.08 | 0.004 | 0.0008 | 0.036 | 0.0041 | 0.0007 | — | — | 0.018 | — | — | — | — |
| C | 0.241 | 1.31 | 3.12 | 0.005 | 0.0010 | 0.040 | 0.0039 | 0.0006 | — | — | — | 0.090 | — | — | — |
| D | 0.152 | 1.52 | 3.42 | 0.010 | 0.0010 | 0.052 | 0.0042 | 0.0008 | — | — | — | — | 0.024 | — | — |
| E | 0.305 | 2.88 | 1.58 | 0.009 | 0.0015 | 0.045 | 0.0048 | 0.0012 | — | — | 0.048 | — | — | 0.198 | — |
| F | 0.248 | 1.36 | 2.79 | 0.011 | 0.0011 | 0.042 | 0.0051 | 0.0004 | 0.0046 | 0.020 | — | — | — | — | — |
| G | 0.285 | 1.45 | 2.26 | 0.004 | 0.0007 | 0.031 | 0.0067 | 0.0006 | — | — | — | — | — | — | — |
| H | 0.212 | 1.05 | 1.42 | 0.012 | 0.0019 | 0.029 | 0.0035 | 0.0007 | — | — | — | 0.022 | — | — | — |
| I | 0.182 | 1.52 | 3.71 | 0.010 | 0.0020 | 0.041 | 0.0041 | 0.0010 | — | — | 0.035 | — | — | — | — |
| J | 0.362 | 1.25 | 2.80 | 0.006 | 0.0015 | 0.036 | 0.0038 | 0.0020 | — | — | — | — | — | — | — |
| K | 0.138 | 1.15 | 3.10 | 0.007 | 0.0012 | 0.055 | 0.0059 | 0.0060 | — | — | — | — | — | — | — |
| L | 0.270 | 1.72 | 2.41 | 0.013 | 0.0009 | 0.039 | 0.0035 | 0.0006 | — | — | — | — | — | — | 0.210 |
| M | 0.254 | 3.20 | 2.64 | 0.015 | 0.0015 | 0.032 | 0.0051 | 0.0050 | — | — | — | — | — | — | — |
| N | 0.253 | 0.68 | 2.52 | 0.018 | 0.0015 | 0.058 | 0.0034 | 0.0030 | — | — | — | — | — | — | — |
| O | 0.321 | 1.62 | 2.89 | 0.008 | 0.0009 | 0.032 | 0.0041 | 0.0004 | — | — | — | — | — | — | — |
| P | 0.241 | 1.39 | 2.65 | 0.006 | 0.0009 | 0.041 | 0.0038 | 0.0006 | — | — | — | — | — | — | — |
| Q | 0.261 | 1.28 | 2.79 | 0.009 | 0.0009 | 0.054 | 0.0042 | 0.0006 | — | — | — | — | — | — | — |

TABLE 1-continued

| Steel symbol | Chemical composition [mass %] C | Si | Mn | P | S | Al | N | O | B | Ti | Nb | V | W | Mo | Cr |
|---|---|---|---|---|---|---|---|---|---|---|---|---|---|---|---|
| R | 0.254 | 1.26 | 2.85 | 0.010 | 0.0009 | 0.042 | 0.0051 | 0.0006 | — | — | — | — | — | — | — |
| S | 0.235 | 1.35 | 2.72 | 0.005 | 0.0009 | 0.053 | 0.0034 | 0.0006 | — | 0.091 | — | — | — | — | — |
| T | 0.189 | 0.84 | 2.87 | 0.015 | 0.0016 | 0.029 | 0.0052 | 0.0015 | — | — | — | — | — | — | — |
| U | 0.225 | 2.76 | 2.65 | 0.016 | 0.0014 | 0.091 | 0.0041 | 0.0016 | — | — | — | — | — | — | — |
| V | 0.341 | 0.92 | 2.65 | 0.012 | 0.0011 | 0.041 | 0.0092 | 0.0004 | — | — | — | — | — | — | — |
| W | 0.235 | 1.26 | 3.46 | 0.010 | 0.0020 | 0.059 | 0.0038 | 0.0006 | — | — | — | — | — | — | — |
| X | 0.235 | 1.32 | 2.21 | 0.015 | 0.0016 | 0.049 | 0.0025 | 0.0004 | — | — | — | — | — | — | — |

TABLE 2

| Steel symbol | Chemical composition [mass %] Sb | Sn | Zr | Cu | Ni | Ca | Mg | Co | Ta | REM | Hf | As | Pb | Zn | Bi | Ms [° C.] |
|---|---|---|---|---|---|---|---|---|---|---|---|---|---|---|---|---|
| A | — | — | — | — | — | — | — | — | — | — | — | — | — | — | — | 355 |
| B | 0.008 | — | — | — | — | — | — | — | — | — | — | — | — | — | — | 315 |
| C | — | — | — | — | — | — | — | — | — | — | — | — | — | — | — | 339 |
| D | — | — | — | — | — | — | — | — | — | — | — | — | — | — | — | 361 |
| E | — | — | — | — | — | — | — | — | — | — | — | — | — | — | — | 379 |
| F | — | — | — | 0.120 | — | — | — | — | — | — | — | — | — | — | — | 352 |
| G | — | — | — | — | — | — | — | — | — | — | — | — | — | — | — | 361 |
| H | — | — | — | — | — | — | — | — | — | — | — | — | — | — | — | 419 |
| I | — | — | — | — | — | — | — | — | — | — | — | — | — | — | — | 339 |
| J | — | — | — | — | — | — | — | — | — | — | — | — | — | — | — | 312 |
| K | — | — | — | — | — | — | — | — | — | — | — | — | — | — | — | 379 |
| L | 0.015 | — | — | — | — | — | — | — | — | — | — | — | — | — | — | 356 |
| M | — | — | — | — | — | — | — | — | — | — | — | — | — | — | — | 356 |
| N | — | — | — | — | — | — | — | — | — | — | — | — | — | — | — | 362 |
| O | — | 0.010 | 0.0220 | — | — | — | — | — | — | — | — | — | — | — | — | 323 |
| P | — | — | — | 0.220 | 0.125 | — | — | — | — | — | — | — | — | — | — | 357 |
| Q | — | — | — | — | — | 0.0012 | 0.0020 | — | — | — | — | — | — | — | — | 349 |
| R | — | — | — | — | — | — | — | 0.05 | — | — | — | — | — | — | — | 349 |
| S | — | — | — | — | — | — | — | — | 0.03 | 0.0010 | — | — | — | — | — | 361 |
| T | — | — | — | — | — | — | — | — | — | — | 0.03 | 0.005 | — | — | — | 370 |
| U | — | — | — | — | — | — | — | — | — | — | — | — | 0.005 | — | — | 368 |
| V | — | — | — | — | — | — | — | — | — | — | — | — | — | 0.004 | — | 326 |
| W | — | — | — | 0.360 | — | — | — | — | — | — | — | — | — | — | 0.013 | 331 |
| X | — | — | — | — | — | — | — | — | — | — | — | — | — | — | 0.004 | 381 |

TABLE 3

| No. | Steel symbol | Hot rolling: Steel slab heating temperature [° C.] | Finish rolling end temperature [° C.] | Coiling temperature [° C.] | Cold rolling Rolling reduction [%] | Heat treatment: Heating temperature [° C.] | Heating time [s] | Average cooling rate v1 [° C./s] |
|---|---|---|---|---|---|---|---|---|
| 1 | A | 1250 | 900 | 460 | 45 | 875 | 130 | 28 |
| 2 | A | 1250 | 900 | 460 | 46 | 875 | 130 | 25 |
| 3 | A | 1250 | 900 | 450 | 45 | 875 | 130 | 12 |
| 4 | A | 1250 | 900 | 450 | 45 | 875 | 130 | 20 |
| 5 | A | 1250 | 900 | 450 | 45 | 875 | 130 | 20 |
| 6 | B | 1250 | 900 | 450 | 50 | 880 | 120 | 23 |
| 7 | B | 1250 | 900 | 450 | 50 | 880 | 120 | 23 |
| 8 | B | 1250 | 900 | 340 | 50 | 880 | 120 | 23 |
| 9 | B | 1250 | 900 | 670 | 50 | 880 | 120 | 23 |
| 10 | C | 1250 | 900 | 470 | 45 | 870 | 100 | 22 |
| 11 | C | 1250 | 900 | 470 | 45 | 960 | 100 | 22 |
| 12 | C | 1250 | 900 | 470 | 45 | 730 | 100 | 22 |
| 13 | C | 1250 | 900 | 470 | 45 | 870 | 100 | 22 |
| 14 | C | 1250 | 900 | 470 | 45 | 870 | 100 | 22 |
| 15 | D | 1250 | 900 | 460 | 50 | 880 | 150 | 15 |
| 16 | E | 1250 | 900 | 460 | 50 | 880 | 120 | 16 |
| 17 | F | 1250 | 900 | 460 | 50 | 880 | 150 | 13 |
| 18 | F | 1250 | 900 | 460 | 50 | 880 | 8 | 13 |

TABLE 3-continued

| | | | | | | | | |
|---|---|---|---|---|---|---|---|---|
| 19 | F | 1250 | 900 | 460 | 50 | 880 | 510 | 13 |
| 20 | F | 1250 | 900 | 460 | 50 | 880 | 150 | 13 |
| 21 | F | 1250 | 900 | 460 | 50 | 880 | 150 | 13 |
| 22 | G | 1250 | 900 | 500 | 50 | 880 | 150 | 13 |
| 23 | G | 1250 | 900 | 500 | 50 | 880 | 150 | 13 |
| 24 | G | 1250 | 900 | 500 | 50 | 880 | 150 | 13 |
| 25 | G | 1250 | 900 | 500 | 50 | 880 | 150 | 6 |
| 26 | H | 1250 | 900 | 510 | 45 | 870 | 110 | 13 |
| 27 | I | 1250 | 900 | 550 | 50 | 880 | 150 | 15 |
| 28 | J | 1250 | 900 | 380 | 45 | 870 | 110 | 22 |
| 29 | K | 1250 | 900 | 380 | 50 | 880 | 150 | 15 |
| 30 | L | 1250 | 900 | 450 | 50 | 880 | 150 | 20 |
| 31 | M | 1250 | 900 | 450 | 50 | 880 | 150 | 20 |
| 32 | N | 1250 | 900 | 450 | 50 | 880 | 150 | 20 |
| 33 | O | 1250 | 900 | 360 | 50 | 865 | 390 | 15 |
| 34 | P | 1250 | 900 | 370 | 45 | 870 | 100 | 15 |
| 35 | Q | 1250 | 900 | 370 | 50 | 880 | 150 | 15 |
| 36 | R | 1250 | 900 | 370 | 50 | 880 | 60 | 14 |
| 37 | S | 1250 | 900 | 550 | 50 | 880 | 150 | 15 |
| 38 | T | 1250 | 900 | 550 | 50 | 880 | 150 | 15 |
| 39 | U | 1250 | 900 | 630 | 45 | 870 | 100 | 14 |
| 40 | V | 1250 | 900 | 610 | 45 | 870 | 100 | 14 |
| 41 | W | 1250 | 900 | 600 | 45 | 870 | 110 | 14 |
| 42 | X | 1250 | 900 | 590 | 45 | 870 | 110 | 14 |

| | Heat treatment | | | | | | |
|---|---|---|---|---|---|---|---|
| No. | Average cooling rate v2 [° C./s] | Cooling stop temperature [° C.] | Reheating temperature [° C.] | Reheating time [s] | Average cooling rate v3 [° C./s] | Plating treatment Type | Remarks |
| 1 | 8 | 200 | 320 | 240 | 4 | CR | Conforming steel |
| 2 | 8 | 200 | 340 | 240 | 4 | CR | Conforming steel |
| 3 | 8 | 250 | 320 | 230 | 4 | GA | Conforming steel |
| 4 | 3 | 200 | 320 | 200 | 4 | CR | Comparative steel |
| 5 | 9 | 200 | 320 | 200 | 12 | CR | Comparative steel |
| 6 | 10 | 210 | 350 | 200 | 3 | CR | Conforming steel |
| 7 | 6 | 250 | 350 | 200 | 3 | EG | Conforming steel |
| 8 | 10 | 210 | 350 | 200 | 5 | CR | Comparative steel |
| 9 | 10 | 210 | 350 | 200 | 6 | CR | Comparative steel |
| 10 | 15 | 220 | 300 | 200 | 3 | CR | Conforming steel |
| 11 | 15 | 220 | 300 | 200 | 4 | GA | Comparative steel |
| 12 | 15 | 220 | 300 | 200 | 4 | EG | Comparative steel |
| 13 | 15 | 100 | 300 | 200 | 5 | CR | Comparative steel |
| 14 | 15 | 320 | 360 | 200 | 3 | CR | Comparative steel |
| 15 | 14 | 280 | 350 | 50 | 6 | CR | Conforming steel |
| 16 | 14 | 250 | 360 | 200 | 6 | CR | Conforming steel |
| 17 | 14 | 220 | 300 | 200 | 4 | CR | Conforming steel |
| 18 | 14 | 220 | 300 | 35 | 5 | CR | Comparative steel |
| 19 | 15 | 220 | 300 | 35 | 5 | CR | Comparative steel |
| 20 | 15 | 220 | 300 | 7 | 6 | GA | Comparative steel |
| 21 | 18 | 220 | 300 | 505 | 5 | CR | Comparative steel |
| 22 | 11 | 220 | 300 | 100 | 4 | CR | Conforming steel |
| 23 | 6 | 150 | 190 | 100 | 5 | GA | Comparative steel |
| 24 | 5 | 220 | 460 | 100 | 6 | CR | Comparative steel |
| 25 | 11 | 220 | 300 | 100 | 3 | CR | Comparative steel |
| 26 | 15 | 200 | 320 | 220 | 5 | CR | Comparative steel |
| 27 | 15 | 280 | 370 | 50 | 6 | CR | Comparative steel |
| 28 | 15 | 200 | 320 | 400 | 8 | CR | Comparative steel |
| 29 | 15 | 280 | 380 | 50 | 7 | CR | Comparative steel |
| 30 | 7 | 200 | 330 | 250 | 8 | CR | Conforming steel |
| 31 | 8 | 210 | 330 | 250 | 7 | CR | Comparative steel |
| 32 | 6 | 210 | 330 | 250 | 6 | CR | Comparative steel |
| 33 | 12 | 210 | 410 | 200 | 3 | GA | Conforming steel |
| 34 | 12 | 220 | 300 | 200 | 6 | GA | Conforming steel |
| 35 | 12 | 220 | 300 | 200 | 4 | GA | Conforming steel |
| 36 | 12 | 140 | 210 | 400 | 4 | GA | Conforming steel |
| 37 | 11 | 200 | 300 | 200 | 3 | GI | Conforming steel |
| 38 | 11 | 280 | 360 | 50 | 3 | CR | Conforming steel |
| 39 | 6 | 220 | 300 | 200 | 5 | GI | Conforming steel |
| 40 | 5 | 220 | 300 | 200 | 5 | EG | Conforming steel |
| 41 | 12 | 200 | 320 | 220 | 6 | CR | Conforming steel |
| 42 | 13 | 200 | 320 | 220 | 6 | CR | Conforming steel |

TABLE 4

| No. | Microstructure: Area ratio [%]: Total of tempered martensite and bainite | Microstructure: Area ratio [%]: Retained austenite | Microstructure: Average circle equivalent diameter of prior austenite grains [μm] | Ratio (b/a) | TS [MPa] | EL [%] | Amount of diffusible hydrogen in-steel [mass ppm] | Fatigue test of spot welded portion | Remarks |
|---|---|---|---|---|---|---|---|---|---|
| 1 | 83 | 9 | 9.8 | 0.65 | 1520 | 11.5 | 0.00 | Excellent | Conforming steel |
| 2 | 88 | 9 | 10.2 | 0.64 | 1490 | 11.1 | 0.00 | Excellent | Conforming steel |
| 3 | 70 | 7 | 9.6 | 0.68 | 1400 | 9.8 | 0.15 | Excellent | Conforming steel |
| 4 | 50 | 7 | 9.2 | 0.75 | 1250 | 9.5 | 0.00 | Excellent | Comparative steel |
| 5 | 80 | 8 | 9.3 | 0.92 | 1500 | 9.9 | 0.00 | Poor | Comparative steel |
| 6 | 80 | 15 | 6.7 | 0.52 | 1550 | 14.4 | 0.00 | Excellent | Conforming steel |
| 7 | 75 | 16 | 6.5 | 0.58 | 1570 | 16.2 | 0.00 | Excellent | Conforming steel |
| 8 | 60 | 6 | 5.2 | 0.85 | 1490 | 8.9 | 0.00 | Poor | Comparative steel |
| 9 | 78 | 9 | 16.5 | 0.65 | 1450 | 10.1 | 0.00 | Poor | Comparative steel |
| 10 | 83 | 10 | 10.5 | 0.63 | 1530 | 11.6 | 0.00 | Excellent | Conforming steel |
| 11 | 93 | 5 | 15.8 | 0.42 | 1540 | 8.5 | 0.65 | Poor | Comparative steel |
| 12 | 40 | 5 | 7.2 | 0.76 | 1210 | 10.2 | 0.00 | Excellent | Comparative steel |
| 13 | 92 | 5 | 8.5 | 0.89 | 1460 | 10.5 | 0.00 | Poor | Comparative steel |
| 14 | 56 | 32 | 8.7 | 0.76 | 1500 | 6.5 | 0.00 | Poor | Comparative steel |
| 15 | 65 | 7 | 9.6 | 0.45 | 1430 | 7.9 | 0.01 | Good | Conforming steel |
| 16 | 70 | 13 | 8.3 | 0.72 | 1480 | 13.5 | 0.00 | Good | Conforming steel |
| 17 | 80 | 10 | 8.9 | 0.59 | 1530 | 10.9 | 0.00 | Excellent | Conforming steel |
| 18 | 40 | 5 | 6.5 | 0.63 | 1300 | 9.2 | 0.01 | Excellent | Comparative steel |
| 19 | 58 | 5 | 15.5 | 0.65 | 1470 | 7.9 | 0.01 | Poor | Comparative steel |
| 20 | 57 | 5 | 9.2 | 0.82 | 1520 | 9.5 | 0.54 | Poor | Comparative steel |
| 21 | 85 | 6 | 8.9 | 0.89 | 1310 | 5.5 | 0.01 | Poor | Comparative steel |
| 22 | 82 | 9 | 9.8 | 0.62 | 1530 | 11.5 | 0.00 | Excellent | Conforming steel |
| 23 | 58 | 6 | 9.6 | 0.87 | 1500 | 10.5 | 0.55 | Poor | Comparative steel |
| 24 | 88 | 7 | 9.8 | 0.65 | 1290 | 8.9 | 0.00 | Poor | Comparative steel |
| 25 | 48 | 5 | 6.2 | 0.62 | 1285 | 9.2 | 0.00 | Excellent | Comparative steel |
| 26 | 60 | 5 | 7.8 | 0.58 | 1160 | 12.6 | 0.01 | Excellent | Comparative steel |
| 27 | 70 | 7 | 7.5 | 0.62 | 1350 | 7.2 | 0.01 | Poor | Comparative steel |
| 28 | 82 | 10 | 9.8 | 0.92 | 1560 | 6.5 | 0.01 | Poor | Comparative steel |
| 29 | 43 | 5 | 9.2 | 0.43 | 1090 | 13.5 | 0.01 | Excellent | Comparative steel |
| 30 | 78 | 9 | 4.5 | 0.60 | 1500 | 10.8 | 0.00 | Excellent | Conforming steel |
| 31 | 75 | 7 | 8.2 | 0.52 | 1410 | 8.2 | 0.01 | Poor | Comparative steel |
| 32 | 78 | 5 | 8.9 | 0.55 | 1310 | 9.8 | 0.01 | Excellent | Comparative steel |
| 33 | 85 | 7 | 12.5 | 0.58 | 1410 | 11.2 | 0.12 | Excellent | Conforming steel |
| 34 | 75 | 9 | 10.1 | 0.72 | 1350 | 8.8 | 0.11 | Excellent | Conforming steel |
| 35 | 78 | 8 | 9.8 | 0.55 | 1380 | 9.2 | 0.12 | Excellent | Conforming steel |
| 36 | 62 | 8 | 8.6 | 0.56 | 1330 | 9.4 | 0.12 | Excellent | Conforming steel |
| 37 | 82 | 9 | 7.8 | 0.60 | 1490 | 9.1 | 0.00 | Excellent | Conforming steel |
| 38 | 60 | 6 | 6.8 | 0.52 | 1360 | 7.5 | 0.00 | Excellent | Conforming steel |
| 39 | 80 | 8 | 9.9 | 0.45 | 1475 | 8.8 | 0.00 | Good | Conforming steel |
| 40 | 82 | 6 | 4.2 | 0.48 | 1330 | 8.2 | 0.00 | Excellent | Conforming steel |
| 41 | 82 | 8 | 9.9 | 0.65 | 1335 | 8.5 | 0.00 | Good | Conforming steel |
| 42 | 80 | 9 | 9.6 | 0.62 | 1460 | 8.4 | 0.00 | Excellent | Conforming steel |

<Summary of Evaluation Results>

As shown in Tables 1 to 4 above, all of the steel sheets of Nos. 1 to 3, 6 and 7, 10, 15 to 17, 22, 30, and 33 to 42 had tensile strength of 1320 MPa or more, and were also excellent in the fatigue strength of the spot welded portion.

Meanwhile, in the steel sheets of Nos. 4 and 5, 8 and 9, 11 to 14, 18 to 21, 23 to 29, and 31 and 32, at least one of the tensile strength and the fatigue strength of the spot welded portion was insufficient.

The invention claimed is:

1. A high-strength cold-rolled steel sheet comprising:

a chemical composition containing

C in an amount of 0.150 to 0.350 mass %,

Si in an amount of 0.80 to 3.00 mass %,

Mn in an amount of 1.50 to 3.50 mass %,

P in an amount of 0.100 mass % or less,

S in an amount of 0.0200 mass % or less,

Al in an amount of 0.100 mass % or less,

N in an amount of 0.0100 mass % or less,

O in an amount of 0.0100 mass % or less, with a remaining part consisting of Fe and inevitable impurities; and a microstructure, wherein an amount of diffusible hydrogen in-steel is 0.50 mass ppm or less, tensile strength is 1320 MPa or more, and in the microstructure, a total area ratio of tempered martensite and bainite is 55 to 95%, an area ratio of retained austenite is 5 to 30%, a prior austenite grain has an average circle equivalent diameter of 15.0 μm or less, and a ratio b/a is 0.80 or less, where a circumferential length of the prior austenite grain is a, and a circumferential length of a portion of the prior austenite grain having a carbon concentration of 0.6 mass % or more is b.

2. The high-strength cold-rolled steel sheet according to claim 1, wherein the chemical composition further contains at least one element selected from the group consisting of B in an amount of 0.0050 mass % or less,
Ti in an amount of 0.200 mass % or less,
Nb in an amount of 0.200 mass % or less,
V in an amount of 0.500 mass % or less,
W in an amount of 0.500 mass % or less,
Mo in an amount of 1.000 mass % or less,
Cr in an amount of 1.000 mass % or less,
Sb in an amount of 0.200 mass % or less,
Sn in an amount of 0.200 mass % or less,
Zr in an amount of 0.1000 mass % or less,
Cu in an amount of 1.000 mass % or less,
Ni in an amount of 1.000 mass % or less,
Ca in an amount of 0.0050 mass % or less,
Mg in an amount of 0.0050 mass % or less,
REM in an amount of 0.0050 mass % or less,
Co in an amount of 0.30 mass % or less,
Ta in an amount of 0.10 mass % or less,
Hf in an amount of 0.10 mass % or less,
As in an amount of 0.100 mass % or less,
Pb in an amount of 0.100 mass % or less,
Zn in an amount of 0.100 mass % or less, and
Bi in an amount of 0.100 mass % or less.

3. The high-strength cold-rolled steel sheet according to claim 2, further comprising a plated layer on a surface of the high-strength cold-rolled steel sheet.

4. The high-strength cold-rolled steel sheet according to claim 3, wherein the plated layer is a hot-dip galvanized layer, a hot-dip galvannealed layer, or an electrogalvanized layer.

5. The high-strength cold-rolled steel sheet according to claim 1, further comprising a plated layer on a surface of the high-strength cold-rolled steel sheet.

6. The high-strength cold-rolled steel sheet according to claim 5, wherein the plated layer is a hot-dip galvanized layer, a hot-dip galvannealed layer, or an electrogalvanized layer.

* * * * *